US005985509A

United States Patent [19]

Dale et al.

[11] Patent Number: 5,985,509

[45] **Date of Patent: *Nov. 16, 1999**

[54] PHOTOGRAPHIC HIGH CONTRAST SILVER HALIDE MATERIAL

[75] Inventors: Allison Hazel C. Dale; Roger H. Piggin, both of Hertfordshire, United Kingdom

[73] Assignee: Eastman Kodak Company, Rochester, N.Y.

[ * ] Notice: This patent is subject to a terminal disclaimer.

[21] Appl. No.: 08/993,089

[22] Filed: Dec. 18, 1997

[30] Foreign Application Priority Data

Dec. 18, 1996 [GB] United Kingdom ..... 9626281

[51] Int. Cl.[6] ..... G03C 1/12; G03C 1/295

[52] U.S. Cl. ..... 430/264; 430/414; 430/415; 430/416; 430/571

[58] Field of Search ..... 430/571, 264, 430/414, 415, 416

[56] References Cited

U.S. PATENT DOCUMENTS

| | | | |
|---|---|---|---|
| 4,030,925 | 6/1977 | Leone et al. . | |
| 4,031,127 | 6/1977 | Leone et al. . | |
| 4,043,817 | 8/1977 | Okutsu et al. . | |
| 4,144,069 | 3/1979 | Yoneyama et al. . | |
| 4,278,748 | 7/1981 | Sidhu et al. . | |
| 4,323,643 | 4/1982 | Mifune et al. . | |
| 4,335,199 | 6/1982 | Michewich et al. . | |
| 4,510,229 | 4/1985 | Oka et al. . | |
| 4,686,174 | 8/1987 | DeKeyzer et al. . | |
| 4,810,623 | 3/1989 | Kokelenberg et al. . | |
| 4,947,354 | 8/1990 | Hethuin . | |
| 5,006,455 | 4/1991 | Patzold et al. | 430/571 |
| 5,030,547 | 7/1991 | Katoh et al. . | |
| 5,098,819 | 3/1992 | Knapp . | |
| 5,238,779 | 8/1993 | Adin et al. . | |
| 5,252,438 | 10/1993 | Nii et al. . | |
| 5,262,271 | 11/1993 | Tahon et al. . | |
| 5,273,859 | 12/1993 | Katoh et al. . | |
| 5,283,158 | 2/1994 | Onodera et al. . | |
| 5,316,889 | 5/1994 | Sakai . | |
| 5,324,622 | 6/1994 | VanRompuy et al. . | |
| 5,342,732 | 8/1994 | Coldrick et al. . | |
| 5,348,836 | 9/1994 | VanRompuy et al. . | |
| 5,362,620 | 11/1994 | Lamotte et al. . | |
| 5,372,911 | 12/1994 | Obi et al. . | |
| 5,665,532 | 9/1997 | Peters et al. | 430/571 |
| 5,736,295 | 4/1998 | Dale et al. | 430/264 |

FOREIGN PATENT DOCUMENTS

| | | |
|---|---|---|
| 0 532 094 A1 | 3/1993 | European Pat. Off. . |
| 0 333 435 B1 | 5/1994 | European Pat. Off. . |

*Primary Examiner*—Thorl Chea
*Attorney, Agent, or Firm*—J. Lanny Tucker

[57] ABSTRACT

A high contrast photographic material comprises a support bearing a silver halide emulsion layer. This material is free from nucleating agents and has a silver:gelatin ratio greater than 1. The emulsion layer comprises silver halide grains that are spectrally sensitized. Moreover, the material contains a density enhancing amine compound in the emulsion layer or in an adjacent hydrophilic colloid layer. The spectrally sensitized silver halide grains comprise one grain population sensitized to radiation of a particular wavelength region, and one or more additional grain populations sensitized to radiation of a different wavelength region.

13 Claims, 4 Drawing Sheets

PHOTOGRAPHIC HIGH CONTRAST SILVER HALIDE MATERIAL

FIELD OF THE INVENTION

The invention relates to high contrast photographic silver halide materials and particularly to those useful as graphic arts films.

BACKGROUND OF THE INVENTION

For many years the very high contrast photographic images needed in the graphic arts and printing industries were obtained by developing a 'lith' emulsion (usually high in silver chloride content) in a hydroquinone, low sulfite, 'lith' developer by the process known as infectious development. High contrasts were achieved. However, such low sulfite developers are inherently unstable and are particularly inappropriate for machine processing.

Machine processing of graphic arts materials was achieved by the use of so called 'rapid access' high contrast materials which have a toe (lower scale) contrast below 3 and typically about 2, good process latitude and good process stability. Such materials are easy to use but this is at the expense of noticeably reduced dot quality. Hence they are not suitable for users requiring the highest of dot qualities. These materials are, however, well accepted and widely used and are in daily use alongside nucleated products described immediately below.

To achieve the high image quality obtainable with lith processing and yet increase the stability of the process, emulsions containing nucleating agents, for example, hydrazides, have been used and processed in a high pH (about pH 11.5) developer with conventional amounts of sulfite, hydroquinone and possibly metol or a pyrazolidone.

A further improvement in the area of high contrast materials was the introduction of a lower pH process (below pH 11) using hydrazides active at this low pH together with the use of a contrast booster compound, for example, one of the boosters described in U.S. Pat. No. 5,316,889 or an amine booster as described in U.S. Pat. No. 4,947,354. The hydrazides proposed for use in such materials are described, for example, in U.S. Pat. No. 4,278,748, U.S. Pat. No. 4,031,127, U.S. Pat. No. 4,030,925 and U.S. Pat. No. 4,323,643 and in EP-A-0 333 435.

The use of incorporated nucleators, for example hydrazides, is not ideal because the process sensitivity is still substantially worse than that obtainable in the rapid access process. This is because nucleation is a 2-phase process, an initial slow induction process followed by a rapid infectious development which will continue until all the silver is consumed or the coating is removed from the developer; hence the time of development and process activity must be controlled with great accuracy. In addition the mechanism of nucleation gives rise to chemical image spread which increases the size of exposed images and can give rise to spontaneous areas of density known as 'pepper fog'.

The infectious process phenomenon of 'co-development' [*The Journal of Photographic Science*(1973) 23 6] is defined as the tendency for unexposed silver halide grains with no latent image to develop if they are in the near vicinity of developing grains which are fogged. No spectral sensitization is described. The extent of the co-development reported has been insufficient to make this little more than an interesting observation.

However, as disclosed in our unpublished co-pending European Patent Application No. 96202204.2, when an imagewise exposed silver halide layer has both spectrally sensitized and non-spectrally sensitized silver halide grains, a high silver:gel ratio and contains an appropriate amine, its density can be enhanced by the co-development effect to give a substantial density gain enabling the production of a high contrast material which does not contain a nucleating agent.

It has now been discovered that the same effect can be achieved with a silver halide layer having spectrally sensitized silver halide grains comprising a grain population sensitized to radiation of a particular wavelength region and one or more grain population(s) sensitized to a radiation of a different wavelength region. Moreover, the silver halide layer is able to respond effectively to radiation of two or more wavelengths.

The object of the present invention is to provide improved high contrast silver halide photographic materials which can be exposed by several different wavelength exposing devices and which do not contain a nucleating agent, which use less silver, gelatin and sensitizing dye to obtain, improved contrast/image quality, lower dye stain through reduced dye laydown and reduced cost.

SUMMARY OF THE INVENTION

According to the present invention there is provided a high contrast photographic material comprising a support bearing a silver halide emulsion layer, the material being free from nucleating agents, and having a silver:gelatin ratio greater than 1, wherein the emulsion layer comprises silver halide grains which are spectrally sensitized, and the material contains a density enhancing amine compound in the emulsion layer or in an adjacent hydrophilic colloid layer, the spectrally sensitized silver halide grains comprising one grain population sensitized to radiation of a particular wavelength region and one or more grain population(s) sensitized to a radiation of a different wavelength region, and one or more additional grain populations sensitized to a radiation of a different wavelength region.

The preferred range of silver:gelatin ratio is from about 1 to about 5, preferably from about 1.5 to about 3.5 and especially from about 2 to about 3.

The present invention allows amplification of the image formed in the spectrally sensitized emulsion grains by the co-development of the different spectrally sensitized grains in the presence of the amine density enhancer. This allows a reduction in the amount of any particular sensitizing dye used as not all the image-forming grains need to be spectrally sensitized with that particular dye.

Since only a proportion of the silver halide grains are spectrally sensitized with any particular dye the substantially lower coated dye levels result in lower post process dye stain and lower product cost.

However, the use of substantially higher dye levels on the spectrally sensitized emulsion grains (only) allows higher product speeds without post process dye stain.

Unlike the amplification seen with hydrazine-type nucleated development, the present amplification process will allow the performance required by users, i.e., low process sensitivity, no chemical image spread and zero pepper fog, while giving improved contrast and image quality relative to the current rapid access materials.

Further, the present invention enables the use of a stable developing solution which again provides low process sensitivity.

As two or more emulsion populations of different spectral sensitivity can be included in the same coated layer and exposure of one emulsion portion results in all emulsion portions being developed, this allows the production of multi-wavelength sensitive products with no more silver than a single use film.

Multi-wavelength, multi-use products give rise to manufacturing cost advantages through larger manufacturing run sizes as well as both material and inventory reduction. In particular, multi-use films are valuable due to reduced diagramming waste. Frequently the specific size of customer rolls needed to be cut from parent rolls leads to high waste or the need to coat specific widths for specific product uses. A multi-use film allows this waste to be re-used for other applications and the coating tracks to coat to the widest web width possible.

DETAILED DESCRIPTION OF THE INVENTION

Figure 1:
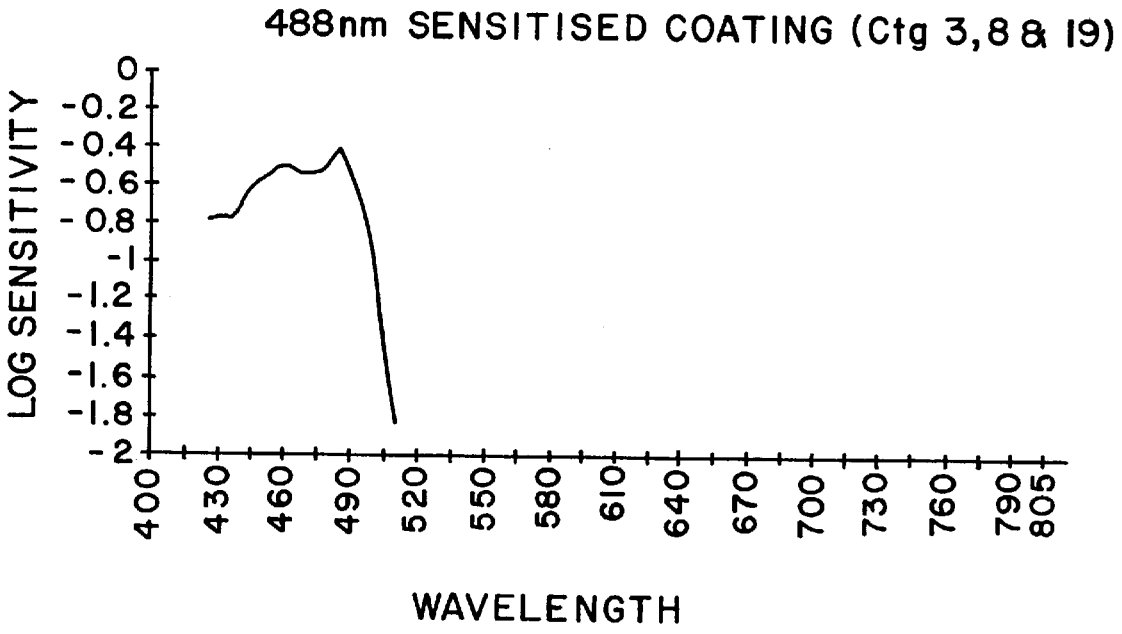
FIGS. 1 to 7 are spectral sensitivity curves for various photographic materials identified in the Examples.

The density enhancing amine compounds are amines which when incorporated into a silver halide material containing both spectrally sensitized and non-spectrally sensitized silver halide grains cause a higher density to be obtained under the conditions of development intended for the product.

In one embodiment of the invention the amine density enhancer is an amine compound which comprises at least one secondary or tertiary amino group, and has an n-octanol/water partition coefficient (log P) of at least one, preferably at least three, and most preferably at least four.

Log P is defined by the formula:

$$\log P = \log \frac{[X_{octanol}]}{[X_{water}]}$$

wherein X is the concentration of the amine compound.

Preferably such an amine compound contains within its structure a group comprised of at least three repeating ethyleneoxy units. Examples of such compounds are described in U.S. Pat. No. 4,975,354. It is preferred that the ethyleneoxy units are directly attached to the nitrogen atom of a tertiary amino group.

Included within the scope of the amine compounds which may be utilized in this invention are monoamines, diamines and polyamines. They can be aliphatic amines or they can include aromatic or heterocyclic moieties. Aliphatic, aromatic and heterocyclic groups present in the amines can be substituted or unsubstituted groups. Preferably, the amine compounds have at least 20 carbon atoms.

In one embodiment the density enhancing amine compound has the general formula I:

$$Y((X)_n—A—B)_m$$

wherein

Y is a group which adsorbs to silver halide,

X is a bivalent linking group composed of hydrogen, carbon, nitrogen and sulfur atoms, A is a bivalent linking group B is an amino group which may be substituted, an ammonium group of a nitrogen-containing heterocyclic group, m is 1, 2 or 3 and n is 0 or 1, or the general formula II:

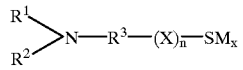

wherein $R^1$ and $R^2$ are each hydrogen or an aliphatic group, or $R^1$ and $R^2$ may together a ring, $R^3$ is a bivalent aliphatic group, X is a bivalent heterocyclic ring having at least one nitrogen, oxygen or sulfur atom as heteroatom, n is 0 or 1, and M is hydrogen or an alkali metal atom, alkaline earth metal atom, a quaternary ammonium, quaternary phosphonium atom or an amidino group, x is 1 when M is a monovalent atom or group and x is 0.5 when M is a divalent atom or group.

The amine compound can also be in the form of an addition salt.

Examples of such compounds are described in U.S. Pat. No. 5,316,889.

Preferred amine compounds for the purposes of this invention are bis-tertiary-amines which have a partition coefficient of at least three and a structure represented by the formula III:

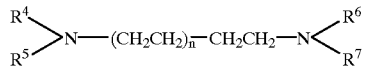

wherein n is an integer with a value of 3 to 50, and more preferably 10 to 50, $R^4$, $R^5$, $R^6$ and $R^7$ are, independently, alkyl groups of 1 to 8 carbon atoms, $R^4$ and $R^5$ taken together represent the atoms necessary to complete a heterocyclic ring, and $R^6$ and $R^7$ taken together represent the atoms necessary to complete a heterocyclic ring.

Another preferred group of amine compounds are bis-secondary amines which have a partition coefficient of at least three and a structure represented by the formula IV:

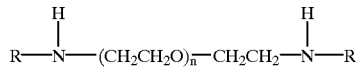

wherein n is an integer with a value of 3 to 50, and more preferably 10 to 50, and each R is, independently, a linear or branched, substituted or unsubstituted, alkyl group of at least 4 carbon atoms.

Particular amine compounds suitable as density enhancers are listed in EP-A-0 364 166.

When the amine compound is incorporated into the photographic material, it may be used in amounts of from about 1 to about 1000 mg/m$^2$, preferably from about 10 to about 500 mg/m$^2$ and, especially, from about 20 to about 200 mg/m$^2$.

It is possible to locate the amine compound in the developer solution used to process the material rather than in the photographic material itself.

The spectrally sensitized grains can be silver bromoiodide, silver chlorobromoiodide, silver bromide, silver chloro-bromide, silver chloroiodide or silver chloride.

In addition to containing spectrally sensitized grains, the silver halide emulsion layer may contain silver halide grains which are not spectrally sensitized. The non-spectrally sensitized grains can be silver bromoiodide, silver chloroiodide, silver chlorobromoiodide, silver bromide, silver chlorobromide, or silver chloride.

Both types of grain may also contain dopants as more fully described below.

Preferably both the spectrally sensitized and the non-spectrally sensitized grains comprise at least about 50 mole percent silver chloride, preferably from about 50 to about 90 mole percent silver chloride.

The size of the latent image-forming and non-latent image-forming grains preferably ranges independently between about 0.05 and about 1.0 mm in equivalent circle diameter, preferably about 0.05 to about 0.5 mm and most preferably about 0.05 to about 0.35 mm. The grain populations in the emulsion layer may have the same or differing grain sizes or morphologies.

In one embodiment of the present invention, the grain size of the non-spectrally sensitized grains is smaller than that of the spectrally sensitized grains because, due to the higher covering power of small grains, the required density may be obtained with less silver halide, i.e., a reduction in overall coated silver laydown can be achieved As is known in the graphic arts field the silver halide grains may be doped with rhodium, ruthenium, iridium or other Group VIII metals either alone or in combination. The grains may be mono- or polydisperse.

Preferably the silver halide grains are doped with one or more Group VIII metal at levels in the range from about $10^{-9}$ to about $10^{-3,}$ preferably from about $10^{-6}$ to about $10^{-3,}$ mole metal per mole of silver. The preferred Group VIII metals are rhodium and/or iridium.

In addition to graphic arts products, the materials of this invention may be black-and-white non-graphic arts photographic materials needing moderate contrasts, for example, microfilm and X-ray products.

The emulsions employed and the addenda added thereto, the binders, supports, etc. may be as described in *Research Disclosure*, Sep. 1994, No. 36544 published by Kenneth Mason Publications, Emsworth, Hants, United Kingdom (hereinafter referred to as *Research Disclosure*).

The hydrophilic colloid may be gelatin or a gelatin derivative, polyvinylpyrrolidone or casein and may contain a polymer. Suitable hydrophilic colloids and vinyl polymers and copolymers are described in Section II of *Research Disclosure*. Gelatin is the preferred hydrophilic colloid.

The present photographic materials may also contain a supercoat hydrophilic colloid layer which may also contain a vinyl polymer or copolymer located as the last layer of the coating (furthest from the support). It may contain some form of matting agent.

The vinyl polymer or copolymer is preferably an acrylic polymer and preferably contains units derived from one or more alkyl or substituted alkyl acrylates or methacrylates, alkyl or substituted alkyl acrylamides or acrylates or acrylamides containing a sulfonic acid group.

The present emulsion layer is preferably formed by dye sensitizing two or more emulsions with two or more dyes so that each emulsion has a different spectral sensitivity to the others and then combining the spectrally sensitized emulsions. Optionally, the emulsions can be combined with a non-spectrally sensitized emulsion. Preferably the sensitizing dyes are chosen so that they do not become desorbed from said spectrally sensitized grains. The blending can be done immediately before coating but this is not necessary as the present blended emulsions are typically stable for at least 20 minutes at coating temperatures.

Two emulsion components can be used where the first component is a "causer" emulsion which is a normal, i.e., chemically and spectrally sensitized component coated in the range 10 to 90%, preferably 30 to 50% by weight of the total silver laydown. The requirements for the second "receiver" emulsion component are that it be clean, i.e., free of fog, and be capable of being developed by the enhanced co-development process.

The lower dye laydown made possible by this invention is also particularly advantageous for systems which have been designed to run under low replenishment rate. Under normal replenishment rates (typically 300 –600 ml/$m^2$ ) there is sufficient overflow of solution to carryout the build up of dye products released into the solution. If these dye products are not bleached by the chemistry then under low replenishment (300 ml/$m^2$ and below) the residual dye builds up to unacceptable levels causing dye stain on the materials being processed. This invention effectively eliminates or reduces this problem by removing the need for the usual amounts of dye. Having only the smaller fraction of the silver composed of a particular spectral sensitivity can often give rise to improvements in linearity of dot reproduction.

Where a particular spectral sensitization requires the use of compounds not necessary in the other emulsion components of the coating, the laydown of these compounds may be reduced. This reduction will lead to cost savings. These compounds may further have undesirable properties, such as high UV Dmin, and their effect can be reduced.

As the speed of any non-spectrally sensitized emulsion is not critical to the final photographic speed of the coated product this emulsion does not require chemical sensitization and thus the production of this component requires fewer steps in the manufacturing process and less stringent quality control leading to manufacturability and cost benefits.

As the maximum density of the material is not primarily dependent upon latent image-forming grains, the invention has the advantage that imaging emulsions of grain size above those used in standard high contrast coatings can be used without the need to increase the overall silver laydown.

The sensitizing dye may be any of the photographic sensitizing dyes described in Section VA of *Research Disclosure*. Specific examples of such dyes include:

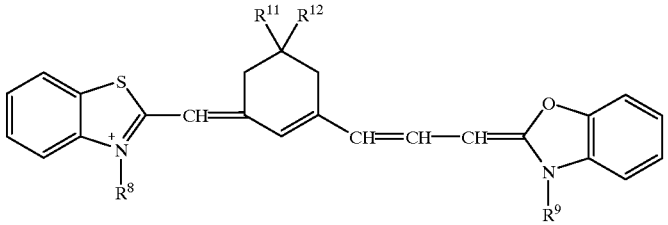

-continued

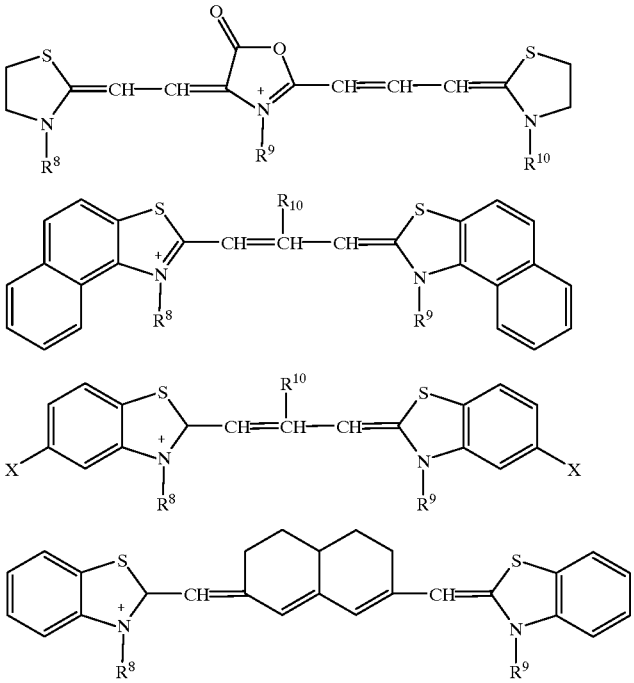

wherein $R^8$, $R^9$ and $R^{10}$ represent an alkyl group which may be substituted, for example with an acid water-solubilizing group, for example a carboxy or sulfo group, $R^{11}$ and $R^{12}$ are an alkyl group of 1–4 carbon atoms, and X is a halogen, for example chloro, bromo, iodo or fluoro.

The photographic material of the invention can respond efficiently to light of two or more wavelengths by providing two or more optimally spectrally sensitized portions such that only the emulsion portion sensitive to the specific exposure radiation, e.g., a laser light is exposed but its development triggers that of neighboring unexposed grains from the other spectrally sensitized portion(s). This allows very efficient use of all the coated silver and use of the film in different exposure devices, e.g., laser exposing devices. The resulting images are high contrast with sharper dots and edges.

The present photographic materials preferably contain an antihalation layer on either side of the support. Preferably it is located on the opposite side of the support from the emulsion layer. In a preferred embodiment an antihalation dye is contained in the hydrophilic colloid underlayer. The dye may also be dissolved or dispersed in the underlayer. Suitable dyes are listed in *Research Disclosure*.

The light-sensitive silver halide contained in the photographic elements can be processed following exposure to form a visible image by associating the silver halide with an aqueous alkaline medium in the presence of a developing agent contained in the medium or the element. It is a distinct advantage of the present invention that the described photographic elements can be processed in conventional developers as opposed to specialized developers conventionally employed in conjunction with lithographic photographic elements to obtain very high contrast images. When the photographic elements contain incorporated developing agents, the elements can be processed in the presence of an activator, which can be identical to the developer in composition, but otherwise lacking a developing agent.

The developers are typically aqueous solutions, although organic solvents, such as diethylene glycol, can also be included to facilitate the solution of organic components. The developers contain one or a combination of conventional developing agents, such as a polyhydroxybenzene, aminophenol, para-phenylenediamine, ascorbic acid, pyrazolidone, pyrazolone, pyrimidine, dithionite, hydroxylamine or other conventional developing agents.

It is preferred to employ hydroquinone and 3-pyrazolidone developing agents in combination. The pH of the developers can be adjusted with alkali metal hydroxides and carbonates, borax and other basic salts. To reduce gelatin swelling during development, compounds such as sodium sulphate can be incorporated into the developer. Chelating and sequestering agents, such as ethylenediaminetetraacetic acid or its sodium salt, can be present. Generally, any conventional developer composition can be employed in the practice of this invention. Specific illustrative photographic developers are disclosed in the Handbook of Chemistry and Physics, 36th Edition, under the title "Photographic Formulae" at page 3001 et seq. and in Processing Chemicals and Formulas, 6th Edition, published by Eastman Kodak Company (1963). The photographic elements can, of course, be processed with conventional developers for lithographic photographic elements, as illustrated by U.S. Pat. No. 3,573,914 and UK Patent No. 376,600.

The present photographic materials are particularly suitable for exposure by red or infra-red laser diodes, light emitting diodes or gas lasers, e.g., a Helium/Neon or Argon laser.

The following Examples are included for a better understanding of the invention.

EXAMPLE 1

A polyethylene terephthalate film support coated with an antihalation pelloid layer on one side was coated on the other side with an emulsion layer consisting of two emulsion melts spectrally sensitized to different regions of the spectrum, an interlayer and a protective supercoat.

The supercoat was a standard formula containing matte beads and surfactants and was coated at a gel laydown of 0.5 $g/m^2$.

The interlayer contained an amine density enhancer compound having the formula $$(C_3H_7)_2N(CH_2CH_2O)_{14}CH_2CH_2N(C_3H_7)_2 \quad (I)$$

at a level of 60 mg/m$^2$ and latex copolymer and was coated at a gel level of 1.0 g/m$^2$.

The emulsion layer was made up as follows:

Melt A

This consisted of a 70:30 silver chlorobromide cubic monodispersed emulsion (0.18 $\mu$m edge length) doped with ammonium pentachlororhodate. The emulsion was also chemically sensitized using N,N'-dicarboxy-methyl-N, N'-dimethylthiourea disodium salt and potassium tetrachloroaurate with a 25 minute digestion at 65 degrees centigrade. It was spectrally sensitized with a sensitizing dye peaking in the 670 rm region having the formula

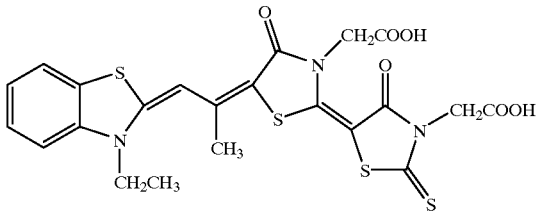

Other melt addenda included potassium iodide, a suitable anti-foggant package and latex copolymer.

Melt B

This consisted of a 70:30 silver chlorobromide cubic monodispersed emulsion (0.18 $\mu$m edge length) doped with ammonium pentachlororhodate. The emulsion was also chemically sensitized using N,N'-dicarboxy-methyl-N, N'-dimethylthiourea disodium salt and potassium tetrachloroaurate with a 25 minute digestion at 65 degrees centigrade. It was spectrally sensitized with a sensitizing dye peaking in the 488 nm region having the formula

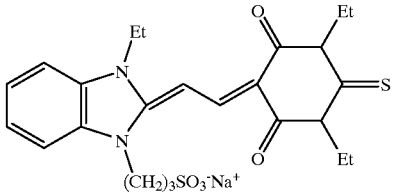

Other melt addenda included potassium iodide, a suitable anti-foggant package and latex copolymer.

The film coating of the invention (Coating 1) was prepared in such a way as to give an overall silver laydown of 3.3 g Ag/m$^2$ and melts A and B were coated in such a way as to give a silver laydown ratio of 1:1. The overall gelatin laydown of this layer was 1.4 g/m$^2$. In order to aid coating of these relatively low gelatin coatings a thickening agent was added to increase melt viscosity. The melts were kept separate until a mixing stage in-line to the coating hopper.

Further control coatings were prepared as follows: Coating 2

This was prepared in the same way as coating 1 but having an emulsion layer consisting of Melt A only, coated so as to give an overall aim silver laydown of 3.3 g Ag/m$^2$.

Coating 3

This was prepared in the same way as coating 1 but having an emulsion layer consisting of Melt B only, coated so as to give an overall aim silver laydown of 3.3 g Ag/m$^2$.

Coating 4

This was prepared in the same way as coating 1 but having an emulsion layer consisting of Melt A only, coated so as to give an overall aim silver laydown of 1.65 g Ag/m$^2$.

Coating 5

This was prepared in the same way as coating 1 but having an emulsion layer consisting of Melt B only, coated so as to give an overall aim silver laydown of 1.65 g Ag/m$^2$.

Coating 6

This was prepared from similar melts to A and B. These melts were prepared so as to give an overall gelatin laydown of 2.4 g/m$^2$ when coated together in a 1:1 ratio with an aim silver laydown of 3.3 g/m$^2$.

Coatings 4 and 5 were prepared in order to give an estimate of the density which could be expected from exposing and developing only one spectral portion of the coating. It should be remembered that these melts are not designed to be coated at these lower laydowns and the actual coated silver should be taken into account when viewing the data. The melts were not rebalanced with gelatin as this would increase the intergrain separation, changing the expected density by destroying the effect of enhanced co-development.

The above coatings were evaluated by exposing a sample to a red laser diode exposing device (being modulated to give a 0.08 density increment) which peaks in the 670 nm region. This would only expose those emulsion grains sensitized with the 670 nm sensitizing dye.

A second sample of these coatings was evaluated by exposing a sample to an argon-ion laser exposing device (being modulated to give a 0.08 density increment) which peaks in the 488 nm region. This would only expose those emulsion grains sensitized with the 488 nm sensitizing dye.

A further set of samples were exposed by a wedge spectrograph.

Figure 2:
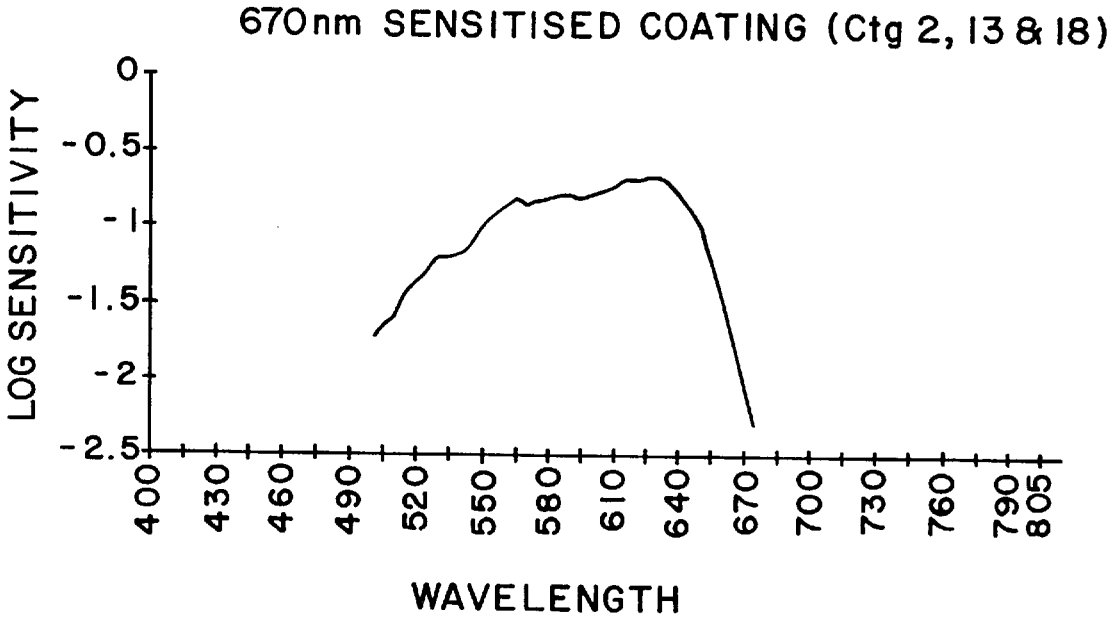
Figure 4:
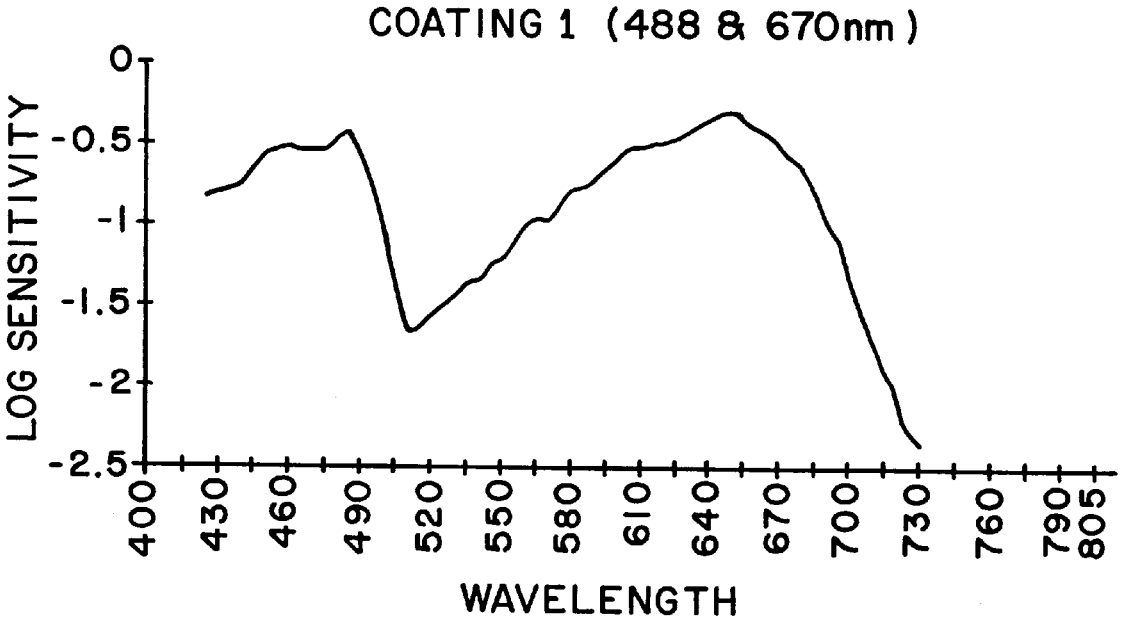

Output spectral sensitivity curves are shown in FIGS. 1, 2 and 4.

The samples were then processed in KODAK RA2000 Developer (diluted 1+2) at 35° C. for 30 seconds.

The sensitometric results are shown in the following table along with the actual silver laydowns as analyzed by X-ray fluorescence.

| | 488 nm exposure | | 670 nm exposure | | Ag laydown |
|---|---|---|---|---|---|
| Coating | Dmax | Speed | Dmax | Speed | mg/m$^2$ |
| 1 | 4.97 | 0.90 | 5.42 | 1.31 | 3.3 |
| 2 | — | — | 5.52 | 1.30 | 3.4 |
| 3 | 5.16 | 0.95 | — | — | 3.3 |
| 4 | — | — | 2.21 | 1.16 | 1.2 |
| 5 | 2.57 | 0.75 | — | — | 1.4 |
| 6 | 3.47 | 0.87 | 3.46 | 1.24 | 3.3 |

The coating of the invention demonstrates speeds similar to the single sensitivity check coatings. If dye equilibration had occurred between the two emulsion melts in this coating, substantial speed losses would have been observed. The coating of the invention also demonstrated considerably more density than would be expected had only the exposed portion of the grains developed (cf. coatings 4 & 5). The coating of the invention also demonstrates significantly higher density than coating 6. This is due to the increased enhanced co-development effect due to the thinner structure and enhanced co-development effect.

Example 2

A polyethylene terephthalate film support coated with an antihalation pelloid layer on one side was coated on the other side with an emulsion layer consisting of two emulsion melts spectrally sensitized to different regions of the spectrum, an interlayer and a protective supercoat.

The supercoat was a standard formula containing matte beads and surfactants and was coated at a gel laydown of 0.5 g/m$^2$.

The interlayer contained an amine density enhancer compound having the formula $$(C_3H_7)_2N(CH_2CH_2O)_{14}CH_2CH_2N(C_3H_7)_2 \quad (I)$$

at a level of 60 mg/m$^2$ and latex copolymer and was coated at a gel level of 1.0 g/m$^2$.

The emulsion layer was made up as follows:

Melt B as in Example 1

Melt C

This consisted of a 70:30 chlorobromide cubic monodispersed emulsion (0.18 $\mu$m edge length) doped with ammonium pentachlororhodate. The emulsion was also chemically sensitized using N,N'-dicarboxy-methyl-N,N'-dimethylthiourea disodium salt and potassium tetrachloroaurate with a 25 minute digestion at 65 degrees centigrade. It was spectrally sensitized with a combination of sensitizing dyes peaking in the 780 nm region having the formulae

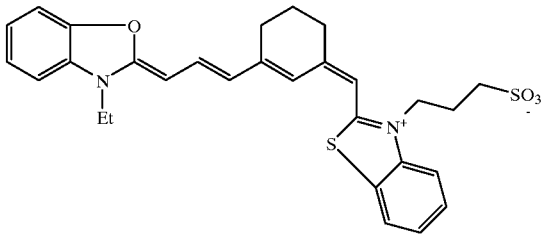

and

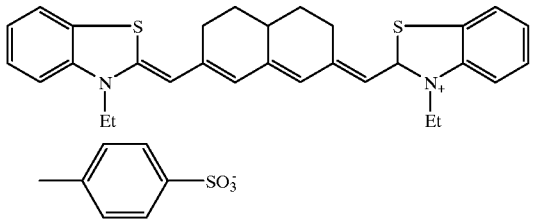

Other melt addenda included potassium iodide, a suitable anti-foggant package and latex copolymer.

The film coating of the invention (Coating 7) was prepared in such a way as to give an overall silver laydown of 3.3 g Ag/m$^2$ and melts A and B were coated in such a way as to give a silver laydown ratio of 1:1. The overall gelatin laydown of this layer was 1.4 g/m$^2$. In order to aid coating of these relatively low gelatin coatings a thickening agent was added to increase melt viscosity. The melts were kept separate until a mixing stage in-line to the coating hopper.

Further control coatings were prepared as follows:

Coating 8

This was prepared in the same way as coating 1 but having an emulsion layer consisting of Melt B only, coated so as to give an overall aim silver laydown of 3.3 g Ag/m$^2$.

Coating 9

This was prepared in the same way as coating 1 but having an emulsion layer consisting of Melt C only, coated so as to give an overall aim silver laydown of 3.3 g Ag/m$^2$.

Coating 10

This was prepared in the same way as coating 1 but having an emulsion layer consisting of Melt B only, coated so as to give an overall aim silver laydown of 1.65 g Ag/m$^2$.

Coating 11

This was prepared in the same way as coating 1 but having an emulsion layer consisting of Melt C only, coated so as to give an overall aim silver laydown of 1.65 g Ag/m$^2$.

Coatings 10 and 11 were prepared in order to give an estimate of the density which could be expected from exposing and developing only one spectral portion of the coating. It should be remembered that these melts are not designed to be coated at these lower laydowns and the actual coated silvers should be taken into account when viewing the data. The melts were not rebalanced with gelatin as this would increase the intergrain separation, changing the expected density by destroying the effect of enhanced co-development.

The above coatings were evaluated by exposing a sample to an infra-red laser diode exposing device (being modulated to give a 0.08 density increment) which peaks in the 780 nm region. This would only expose those emulsion grains sensitized with the 780 nm sensitizing dye.

A second sample of these coatings was evaluated by exposing a sample to an argon-ion laser exposing device (being modulated to give a 0.08 density increment) which peaks in the 488 nm region. This would only expose those emulsion grains sensitized with the 488 nm sensitizing dye.

Figure 3:
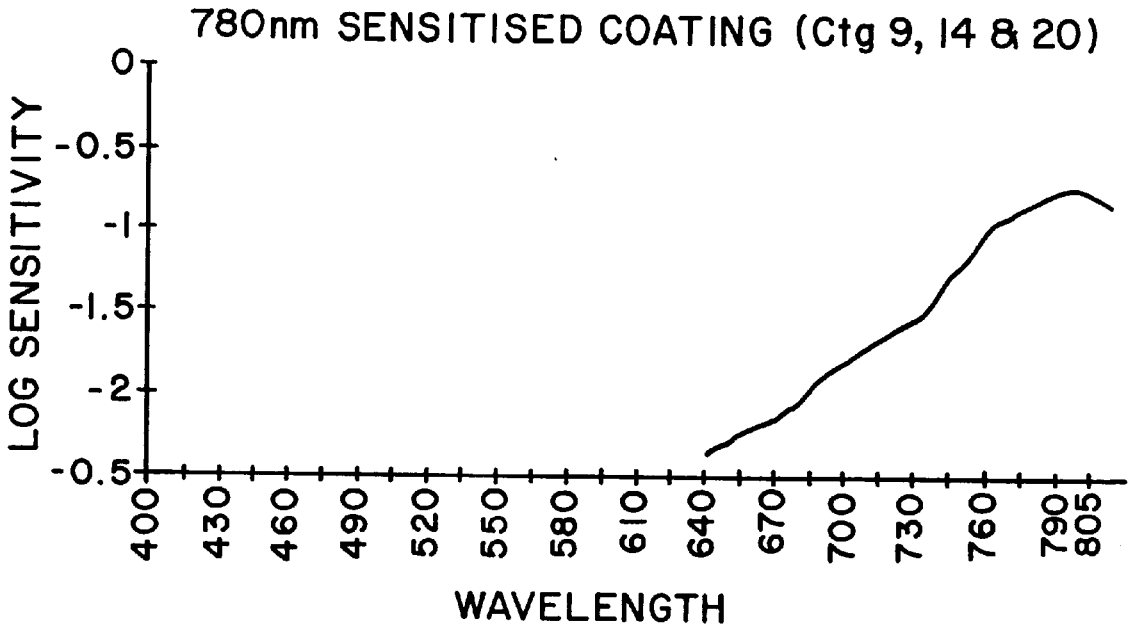
Figure 5:
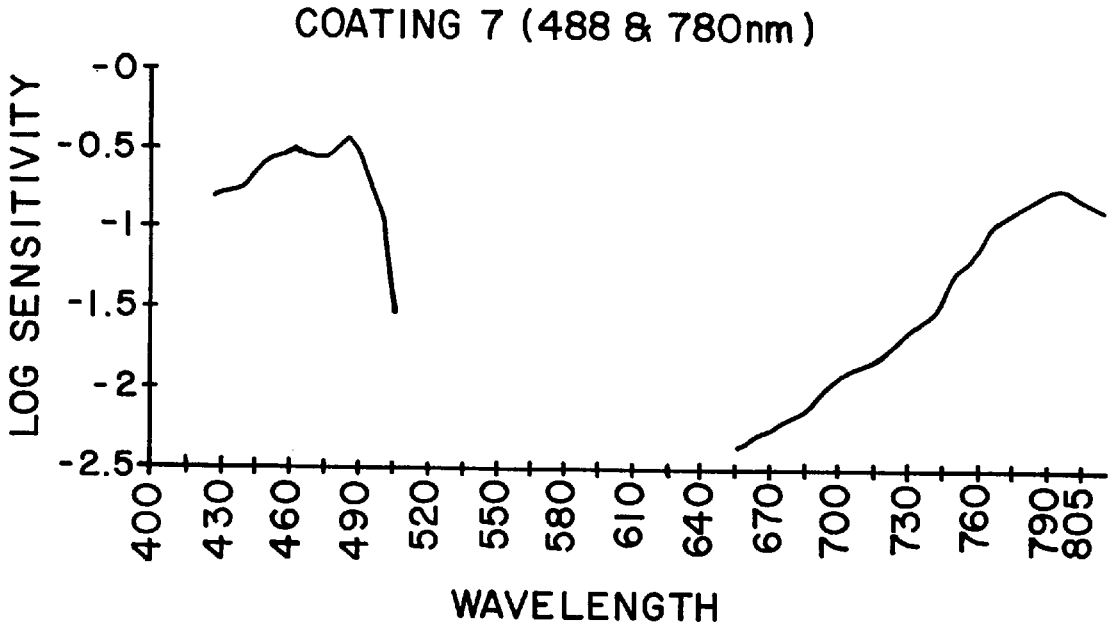

A further set of samples were exposed by a wedge spectrograph. The output curves are shown in FIGS. 1, 3 and 5.

The samples were then processed in KODAK RA2000 Developer (diluted 1+2) at 35° C. for 30 seconds.

The sensitometric results are shown in the following table.

| | 488 nm exposure | | 780 nm exposure | | Ag laydown |
|---|---|---|---|---|---|
| Coating | Dmax | Speed | Dmax | Speed | mg/m$^2$ |
| 7 | 5.0 | 0.92 | 5.11 | 0.95 | 3.3 |
| 8 | 5.16 | 0.95 | — | — | 3.3 |
| 9 | — | — | 5.21 | 1.00 | 3.3 |
| 10 | 2.57 | 0.75 | — | — | 1.4 |
| 11 | — | — | 1.72 | 0.76 | 1.0 |

EXAMPLE 3

A polyethylene terephthalate film support coated with an antihalation pelloid layer on one side was coated on the other side with an emulsion layer consisting of two emulsion melts spectrally sensitized to different regions of the spectrum, an interlayer and a protective supercoat.

beads and surfactants and was coated at a gel laydown of 0.5 g/m$^2$.

The interlayer contained an amine density enhancer compound having the formula $$(C_3H_7)_2N(CH_2CH_2O)_{14}CH_2CH_2N(C_3H_7)_2 \quad (I)$$

at a level of 60 mg/M$^2$ and latex copolymer and was coated at a gel level of 1.0 g/m$^2$.

The emulsion layer was made up as follows:

Melt A as in Example 1

Melt C as in Example 2

The film coating of the invention (Coating 12) was prepared in such a way as to give an overall silver laydown of 3.3 g Ag/m$^2$ and melts A and B were coated in such a way as to give a silver laydown ratio of 1:1. The overall gelatin laydown of this layer was 1.4 g/m$^2$. In order to aid coating of these relatively low gelatin coatings a thickening agent was added to increase melt viscosity. The melts were kept separate until a mixing stage in-line to the coating hopper.

Further control coatings were prepared as follows:

Coating 13

This was prepared in the same way as coating 1 but having an emulsion layer consisting of Melt A only, coated so as to give an overall aim silver laydown of 3.3 g Ag/m$^2$.

Coating 14

This was prepared in the same way as coating 1 but having an emulsion layer consisting of Melt C only, coated so as to give an overall aim silver laydown of 3.3 g Ag/m$^2$.

Coating 15

This was prepared in the same way as coating 1 but having an emulsion layer consisting of Melt A only, coated so as to give an overall aim silver laydown of 1.65 g Ag/m$^2$.

Coating 16

This was prepared in the same way as coating 1 but having an emulsion layer consisting of Melt C only, coated so as to give an overall aim silver laydown of 1.65 g Ag/m$^2$.

Coatings 15 and 16 were prepared in order to give an estimate of the density which could be expected from exposing and developing only one spectral portion of the coating. It should be remembered that these melts are not designed to be coated at these lower laydowns and the actual coated silvers should be taken into account when viewing the data. The melts were not rebalanced with gelatin as this would increase the intergrain separation, changing the expected density by destroyed the effect of enhanced co-development.

The above coatings were evaluated by exposing a sample to a red laser diode exposing device (being modulated to give a 0.08 density increment) which peaks in the 670 nm region. This would only expose those emulsion grains sensitized with the 670 nm sensitizing dye.

A second sample of these coatings were evaluated by exposing a sample to an infra-red laser diode exposing device (being modulated to give a 0.08 density increment) which peaks in the 780 nm region. This would only expose those emulsion grains sensitized with the 780 nm sensitizing dye.

Figure 6:
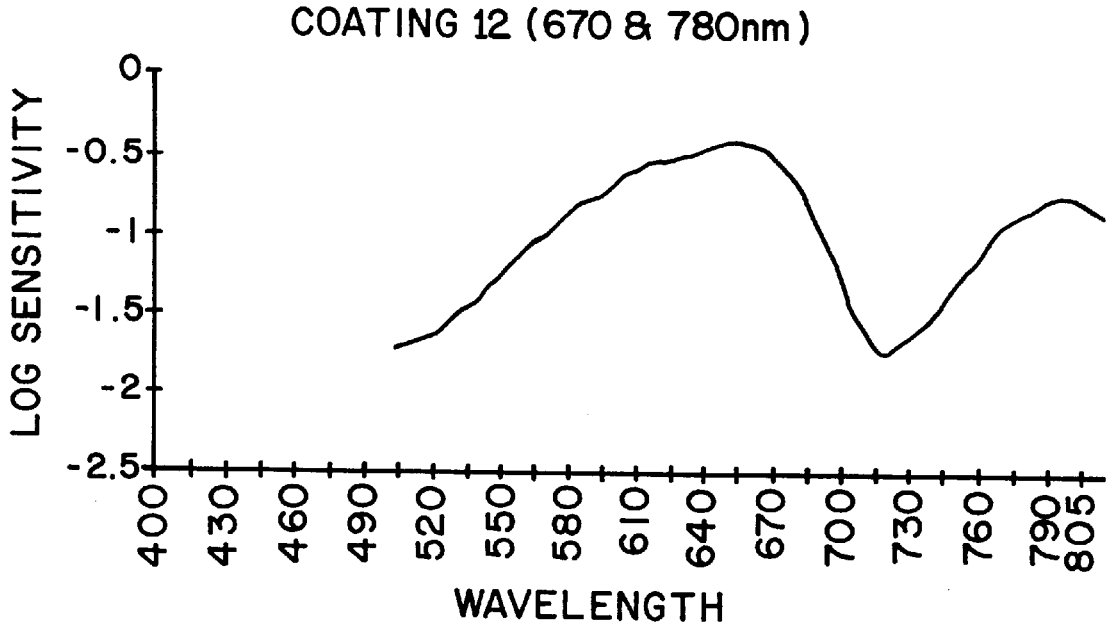
Figure 7:
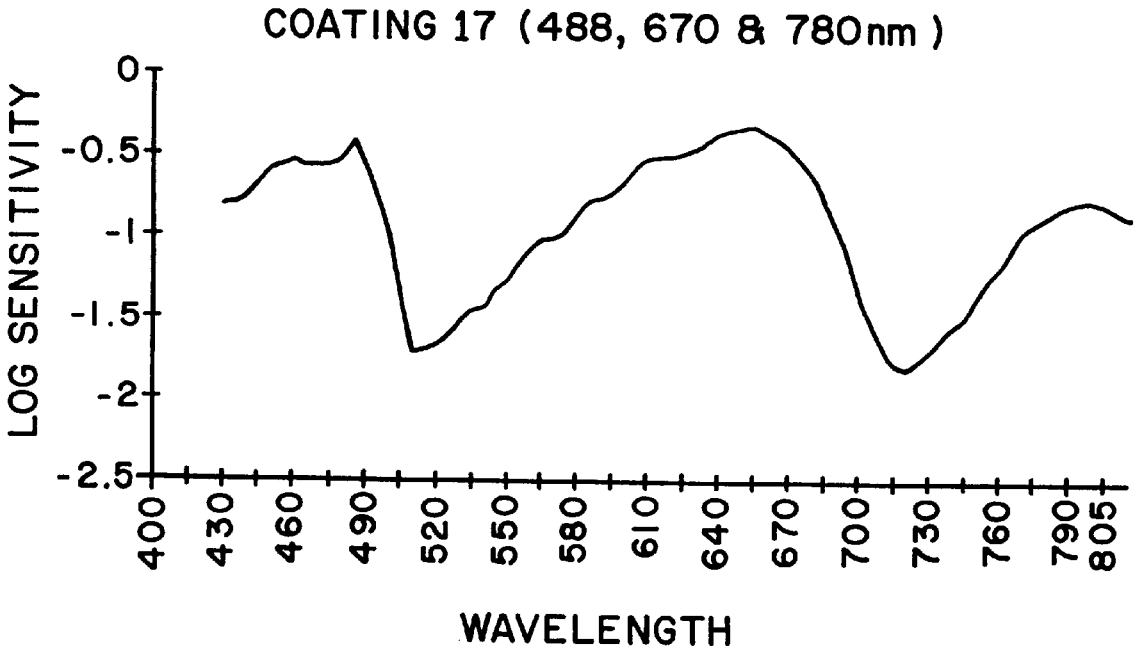

A further set of samples were exposed by a wedge spectrograph. The output curves are shown in FIGS. 2, 3 and 6.

The samples were then processed in KODAK RA2000 Developer (diluted 1+2) at 35° C. for 30 seconds.

The sensitometric results are shown in the following table.

| | 670 nm exposure | | 780 nm exposure | | Ag laydown |
|---|---|---|---|---|---|
| Coating | Dmax | Speed | Dmax | Speed | mg/m$^2$ |
| 12 | 5.21 | 1.28 | 5.08 | 0.96 | 3.3 |
| 13 | 5.52 | 1.30 | — | — | 3.4 |
| 14 | — | — | 5.21 | 1.00 | 3.3 |
| 15 | 2.21 | 1.16 | — | — | 1.2 |
| 16 | — | — | 1.72 | 0.76 | 1.0 |

EXAMPLE 4

A polyethylene terephthalate film support coated with an antihalation pelloid layer on one side was coated on the other side with an emulsion layer consisting of two emulsion melts spectrally sensitized to different regions of the spectrum, an interlayer and a protective supercoat.

The supercoat was a standard formula containing matte beads and surfactants and was coated at a gel laydown of 0.5 g/m$^2$.

The interlayer contained an amine density enhancer compound having the formula $$(C_3H_7)_2N(CH_2CH_2O)_{14}CH_2CH_2N(C_3H_7)_2 \quad (I)$$

at a level of 60 mg/m$^2$ and latex copolymer and was coated at a gel level of 1.0 g/m$^2$.

The emulsion layer was made up as follows:

Melt A as in Example 1.

Melt B as in Example 1.

Melt C as in Example 2.

The film coating of the invention (Coating 17) was prepared in such a way as to give an overall silver laydown of 3.3 g Ag/m$^2$ and melts A, B and C were coated in such a way as to give a silver laydown ratio of 1:1:1. The overall gelatin laydown of this layer was 1.4 g/m$^2$. In order to aid coating of these relatively low gelatin coatings a thickening agent was added to increase melt viscosity. The melts were kept separate until a mixing stage in-line to the coating hopper.

Further control coatings were prepared as follows:

Coating 18

This was prepared in the same way as coating 1 but having an emulsion layer consisting of Melt A only, coated so as to give an overall aim silver laydown of 3.3 g Ag/m$^2$.

Coating 19

This was prepared in the same way as coating 1 but having an emulsion layer consisting of Melt B only, coated so as to give an overall aim silver laydown of 3.3 g Ag/m$^2$.

Coating 20

This was prepared in the same way as coating 1 but having an emulsion layer consisting of Melt B only, coated so as to give an overall aim silver laydown of 3.3 g Ag/m$^2$.

Coating 21

This was prepared in the same way as coating 1 but having an emulsion layer consisting of Melt A only, coated so as to give an overall aim silver laydown of 1.1 g Ag/m$^2$.

The above coatings were evaluated by exposing a sample to a red laser diode exposing device (being modulated to give a 0.08 density increment) which peaks in the 670 nm region. This would only expose those emulsion grains sensitized with the 670 nm sensitizing dye.

A second sample of these coatings was evaluated by exposing a sample to an argon-ion laser exposing device (being modulated to give a 0.08 density increment) which peaks in the 488 nm region. This would only expose those emulsion grains sensitized with the 488 nm sensitizing dye.

A third sample of these coatings were evaluated by exposing a sample to an infra-red laser diode exposing device (being modulated to give a 0.08 density increment) which peaks in the 780 nm region. This would only expose those emulsion grains sensitized with the 780 nm sensitizing dye.

A further set of samples were exposed by a wedge spectrograph. The output curves are shown in FIGS. 1–3 and 7.

The samples were then processed in KODAK RA2000 Developer (diluted 1+2) at 35° C. for 30 seconds.

The sensitometric results are shown in the following table.

| | 488 nm exposure | | 670 nm exposure | | 780 nm exposure | | Ag |
|---|---|---|---|---|---|---|---|
| Coating | Dmax | Speed | Dmax | Speed | Dmax | Speed | g/m$^2$ |
| 17 | 4.45 | 0.87 | 4.73 | 1.26 | 5.22 | 0.90 | 3.3 |
| 18 | — | — | 5.52 | 1.30 | — | — | 3.4 |
| 19 | 5.16 | 0.95 | — | — | — | — | 3.3 |
| 20 | — | — | — | — | 5.21 | 1.00 | 3.3 |
| 21 | — | — | 1.36 | 1.05 | — | — | 0.8 |

The invention has been described in detail with particular reference to certain preferred embodiments thereof, but it will be understood that variations and modifications can be effected within the spirit and scope of the invention.

We claim:

1. A high contrast photographic material comprising a support bearing a silver halide emulsion layer, said material being free from nucleating agents, and having a silver:gelatin weight ratio greater than 1, wherein said emulsion layer comprises silver halide grains which are spectrally sensitized, and said material contains a density enhancing amine compound in said emulsion layer or in an adjacent hydrophilic colloid layer, said spectrally sensitized silver halide grains comprising one grain population sensitized to radiation of a particular wavelength region, and one or more additional grain populations, each one or more additional grain populations being sensitized to a radiation of a different wavelength region.

2. The photographic material of claim 1 wherein the silver:gelatin weight ratio is from about 1 to about 5.

3. The photographic material of claim 1 wherein said density enhancing amine compound:

(a) comprises at least one secondary or tertiary amino group, and (b) has an n-octanol/water partition coefficient (log P) of at least one, log P being defined by the formula:

$$\log P = \log \frac{[X_{octanol}]}{[X_{water}]}$$

wherein X is the concentration of said amine compound.

4. The photographic material wherein said amine compound has a log P of at least 3.

5. The photographic material of claim 3 wherein said amine compound contains within its structure a group comprised of at least three repeating ethyleneoxy units.

6. The photographic material of claim 1 wherein said amine compound has the general formula I:

$$Y((X)_n—A—B)_m$$

wherein

Y is a group that adsorbs to silver halide,

X is a bivalent linking group composed of hydrogen, carbon, nitrogen and sulfur atoms, B is an amino group which may be substituted, an ammonium group of a nitrogen-containing heterocyclic group, m is 1, 2 or 3 and n is 0 or 1, or the general formula II:

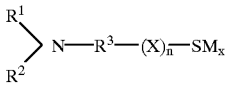

wherein $R^1$ and $R^2$ are each hydrogen or an aliphatic group, or $R^1$ and $R^2$ may together a ring, $R^3$ is a bivalent aliphatic group, X is a bivalent heterocyclic ring having at least one nitrogen, oxygen or sulfur atom as heteroatom, n is 0 or 1, and M is hydrogen or an alkali metal atom, alkaline earth metal atom, a quaternary ammonium, quaternary phosphonium atom or an amidino group, x is 1 or ½ when M is a divalent atom, said amine compound optionally being in the form of an addition salt.

7. The photographic material of claim 1 wherein said emulsion layer further comprises non-spectrally sensitized silver halide grains.

8. The photographic material of claim 1 wherein the size of the silver halide grains range independently from 0.05 to 1.0 $\mu$m in equivalent circle diameter.

9. The photographic material of claim 1 wherein said silver halide grains are chemically sensitized.

10. The photographic material of claim 1 wherein said silver halide grains comprise from about 50 to about 90 mole % silver chloride.

11. The photographic material of claim 1 wherein said amine compound is present at from about 1 to about 1000 mg/m$^2$.

12. The photographic material of claim 11 wherein said amine compound is present at from about 10 to about 500 mg/m$^2$.

13. The photographic material of claim 1 that is a graphic arts film.

* * * * *